US006290584B1

(12) United States Patent
Kim et al.

(10) Patent No.: US 6,290,584 B1
(45) Date of Patent: Sep. 18, 2001

(54) WORKPIECE CARRIER WITH SEGMENTED AND FLOATING RETAINING ELEMENTS

(75) Inventors: Inki Kim; Mark Meloni, both of Tempe; Mike Park, Phoenix, all of AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/374,722

(22) Filed: Aug. 13, 1999

(51) Int. Cl.[7] ..... B24B 29/00
(52) U.S. Cl. ..... 451/288; 451/398
(58) Field of Search ..... 451/285–288, 451/41, 63, 289, 397, 398

(56) References Cited

U.S. PATENT DOCUMENTS

| | | | |
|---|---|---|---|
| 5,329,732 | | 7/1994 | Karlsrud et al. . |
| 5,584,751 | | 12/1996 | Kobayashi et al. . |
| 5,695,392 | | 12/1997 | Kim . |
| 5,795,215 | | 8/1998 | Guthrie et al. . |
| 5,836,807 | * | 11/1998 | Leach ..... 451/41 |
| 5,954,570 | | 9/1999 | Yano et al. ..... 451/285 |
| 6,024,630 | * | 2/2000 | Shendon et al. ..... 451/41 |
| 6,050,882 | * | 4/2000 | Chen ..... 451/41 |
| 6,056,632 | * | 5/2000 | Mitchel et al. ..... 451/288 |
| 6,080,040 | * | 6/2000 | Appel et al. ..... 451/10 |
| 6,089,961 | * | 7/2000 | Cesna et al. ..... 451/285 |

* cited by examiner

*Primary Examiner*—Derris H. Banks
*Assistant Examiner*—David B. Thomas
(74) *Attorney, Agent, or Firm*—Snell & Wilmer, LLP

(57) ABSTRACT

An improved workpiece carrier assembly includes a workpiece retaining assembly having a plurality of distinct retaining elements rather than a one-piece retaining ring. In accordance with one embodiment, a plurality of retaining segments reside within a like plurality of channels. The retaining segments may be individually or collectively controlled by a pressurized fluid system. In accordance with an alternate embodiment, a plurality of retaining pins reside within a like plurality of guide sleeves. The retaining pins may be individually or collectively controlled by a pressurized fluid system.

10 Claims, 6 Drawing Sheets

WORKPIECE CARRIER WITH SEGMENTED AND FLOATING RETAINING ELEMENTS

FIELD OF THE INVENTION

The present invention relates, generally, to systems for polishing or planarizing work pieces such as semiconductor wafers. More particularly, the present invention relates to a workpiece carrier that engages a workpiece against a polishing surface during a polishing procedure.

BACKGROUND OF THE INVENTION

Many electronic and computer-related products such as semiconductors, CD-ROMs, and computer hard disks, require highly polished surfaces in order to achieve optimum operational characteristics. For example, high-quality and extremely precise wafer surfaces are often needed during the production of semiconductor-based integrated circuits. During the fabrication process, the wafers generally undergo multiple masking, etching, and dielectric and conductor deposition processes. Because of the high-precision required in the production of these integrated circuits, an extremely flat surface is generally needed on at least one side of the semiconductor wafer to ensure proper accuracy and performance of the microelectronic structures created on the wafer surface. As the size of integrated circuits decreases and the density of microstructures on integrated circuits increases, the need for accurate and precise wafer surface polishing increases.

Chemical Mechanical Polishing ("CMP") machines have been developed to polish or planarize semiconductor wafer surfaces to the flat condition desired for integrated circuit components and the like. For examples of conventional CMP processes and machines, see U.S. Pat. No. 4,805,348, issued Feb. 21, 1989 to Arai et al.; U.S. Pat. No. 4,811,522, issued Mar. 14, 1989 to Gill; U.S. Pat. No. 5,099,614, issued Mar. 31, 1992 to Arai et al.; U.S. Pat. No. 5,329,732, issued Jul. 19, 1994 to Karlsrud et al.; U.S. Pat. No. 5,498,196, issued Mar. 12, 1996 to Karlsrud et al.; U.S. Pat. No. 5,498,199, issued Mar. 12, 1996 to Karlsrud et al.; U.S. Pat. No. 5,558,568, issued Sep. 24, 1996 to Talieh et al.; and U.S. Pat. No. 5,584,751, issued Dec. 17, 1996 to Kobayashi et al.

Typically, a CMP machine includes a wafer carrier configured to hold, rotate, and transport a wafer during the process of polishing or planarizing the wafer. The wafer carrier is rotated to cause relative lateral motion between the polishing surface and the wafer to produce a substantially uniform thickness. In general, the polishing surface includes a horizontal polishing pad that has an exposed abrasive surface of cerium oxide, aluminum oxide, fumed/precipitated silica, or other particulate abrasives. Commercially available polishing pads may utilize various materials, as is known in the art. Typically, polishing pads may be formed from a blown polyurethane, such as the IC and GS series of polishing pads available from Rodel Products Corporation in Scottsdale, Ariz. The hardness and density of the polishing pad depends on the material that is to be polished and the degree of precision required in the polishing process.

During a polishing operation, a pressure applying element (e.g., a rigid plate, a bladder assembly, or the like), which may be integral to the wafer carrier, applies pressure such that the wafer engages the polishing surface with a desired amount of force. The carrier and the polishing pad are rotated, typically at different rotational velocities, to cause relative lateral motion between the polishing pad and the wafer and to promote uniform polishing. Most conventional carrier assemblies include some form of retaining structure that maintains the position of the wafer under the pressure element during polishing. Prior art carrier assemblies designed for compatibility with circular wafers employ round retaining structures such as retaining rings.

Retaining rings may either be fixed or "floating" within the wafer carrier. For example, U.S. Pat. No. 5,695,392, issued Dec. 9, 1997 to Kim, discloses the use of a fixed retaining ring collar that is bolted to the main carrier housing. U.S. Pat. No. 5,584,751, issued Dec. 17, 1996 to Kobayashi et al., and U.S. Pat. No. 5,795,215, issued Aug. 18, 1998 to Guthrie et al., each teach the use of a floating retaining ring and a pressure regulating mechanism that controls the biasing pressure applied to the retaining ring.

Although floating retaining rings may improve the edge profile of the polished wafer (i.e., reduce the amount of tapering or chamfering near the wafer edge due to over polishing), such improvement is typically dependent upon the flatness and precision of the retaining ring itself. For example, if the retaining ring is not completely flat, then it will not compress the polishing pad in a uniform manner. In addition, one-piece retaining rings may roll or tilt during the polishing process (which can also lead to nonuniform compression of the polishing pad). Nonuniform compression of the polishing pad may cause uneven polishing of the wafer, particularly near the wafer edge. Furthermore, polishing of local areas of the wafer edge cannot be controlled with a one-piece retaining ring.

One-piece retaining rings may be difficult to maintain and time consuming to replace. For the reasons discussed above, one-piece retaining rings (whether fixed or floating) may experience uneven wear that can adversely affect the uniformity of the polished wafer. If a one-piece retaining ring has an uneven pressure surface, then it will either need to be replaced or repaired by machining the pressure surface to a desired flatness. The downtime associated with the repair or replacement of a one-piece retaining ring may be extremely undesirable, particularly if the workpiece throughput rate is critical.

SUMMARY OF THE INVENTION

Accordingly, the present invention provides an improved workpiece retaining structure for use with a workpiece carrier element. The improved retaining structure, which employs a plurality of floating elements, promotes a more uniform compression of the polishing surface and, consequently, a more uniform polishing of the workpiece. Unlike conventional one-piece retaining rings, one embodiment of the present invention may be configured to provide an enhanced amount of polishing control near the edge of the wafer. Furthermore, the improved retaining structure is easy to maintain and it requires less downtime for repairs, relative to conventional retaining ring assemblies.

The above and other advantages of the present invention may be carried out in one form by an exemplary workpiece carrier for use with a workpiece polishing system. The workpiece carrier preferably includes a carrier housing having an upper end and a lower end; a pressure element operatively associated with the carrier housing and being configured to hold a workpiece against a polishing surface during a polishing operation associated with the workpiece polishing system; and a workpiece retaining assembly integral to the carrier housing. The workpiece retaining assembly includes a plurality of distinct retaining elements that cooperate with the pressure element to define a cavity for receiving at least a portion of the workpiece, and each of the distinct retaining elements is capable of independent movement relative to the carrier housing.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION OF A PREFERRED EMBODIMENT

The subject invention relates generally to the polishing of work pieces such as semiconductor wafers. It will be understood, however, that the invention is not limited to a particular workpiece type or to a particular manufacturing or polishing environment.

Figure 1:
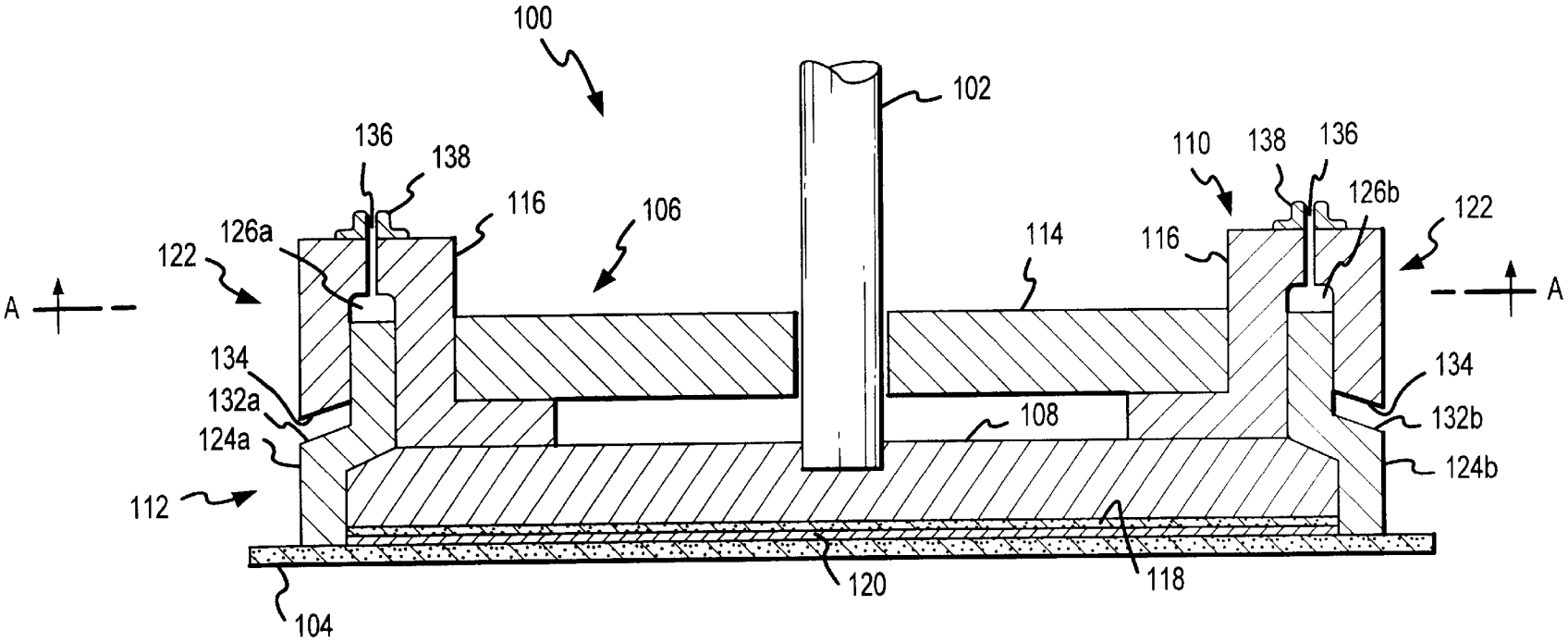
FIG. 1 is a sectional view of an exemplary workpiece carrier according to the present invention.

FIG. 1 depicts a wafer carrier 100 according to one embodiment of the present invention.

For the sake of clarity and brevity, wafer carrier 100 is illustrated in a simplistic manner without a number of components that may be present in a practical carrier. Typically, carrier 100 is mounted at the end of a rotatable and vertically movable drive shaft 102, and above a rotatable polishing surface, e.g., a pad 104, affixed to a platen (not shown). Wafer carrier 100 and the above components are typically integral to a chemical mechanical polishing ("CMP") machine or a similar workpiece polishing apparatus. CMP machines are well known in the art; a detailed description of the construction and operation of an exemplary CMP system may be found in U.S. Pat. No. 5,329,732, issued Jul. 19, 1994 to Karlsrud et al., the disclosure of which is incorporated herein by reference.

Wafer carrier 100 includes a carrier housing 106 to which a pressure applying element 108 is operatively coupled. Pressure element 108 may be rigidly coupled to carrier housing 106 or movably coupled to carrier housing 106, depending upon the particular configuration of wafer carrier 100. For example, in the illustrated embodiment, pressure element 108 is configured as a rigid pressure plate that is fixed to at least a portion of carrier housing 106. Accordingly, pressure element 108 and carrier housing 106 move as a single unit in wafer carrier 100. It should be appreciated that the present invention may be embodied in the context of any number of practical wafer carrier designs, e.g., those utilizing floating pressure plates and gimbal mechanisms, those utilizing fluid driven bladders or membranes instead of rigid pressure plates, those utilizing floating bladder assemblies, and those using any combination of such techniques.

Carrier housing 106 includes an upper end 110 and a lower end 112, where "upper" and "lower" refer to the normal operating position of wafer carrier 100. Carrier housing 106 may include or be associated with any number of cooperating components that serve to define the overall structure of wafer carrier 100. For example, in the embodiment illustrated in FIG. 1, carrier housing 106 may be considered to include structural elements 114 and 116. In other embodiments, carrier housing 106 may be a one piece component that serves as a foundation for any number of other components of carrier 100.

In FIG. 1, pressure element 108 is a unitary component formed of a rigid material, such as steel. Pressure element 108 is configured to hold a workpiece against polishing pad 104 during a polishing operation associated with the CMP system. In other words, pressure element 108 is configured to bias a workpiece away from upper end 110 during the polishing operation. Wafer carrier 100 may employ any number of known techniques to apply, regulate, and control the amount of pressure impaired by pressure element 108. A compliant wafer backing pad 118 is adhered to the lower surface of pressure element 108 to cushion wafers held thereby and to protect the wafers against damage which may result from direct contact with the pressure element 108. The rear face of the wafer or other workpiece 120 rests in parallel contact against backing pad 118; while the front face of the workpiece 120 is exposed for parallel contact against the top surface of polishing pad 104. The backing pad prevents imperfections or material present on the rear face of the wafer from being transferred through the wafer to its front (polishing) face, which can result in uneven pressure distribution across the wafer front face against the polishing pad 104 which, in turn, can lead to uneven material removal rates and impaired planarization. The backing pad also frictionally engages the rear surface of the wafer 120, thereby minimizing movement or sliding of the wafer 120 relative to the backing pad 118.

During the CMP procedure, polishing pad 104 is located below wafer carrier 100 on a rotatable polishing platen (not shown). The hardness and density of the pad are selected based on the type of material to be planarized. Blown polyurethane pads, such as the IC and GS series of pads available from Rodel Products Corporation of Scottsdale, Ariz., may be advantageously utilized by the CMP system. An abrasive slurry, such as an aqueous slurry of silica particles, is typically pumped onto the polishing pad 104 during a polishing operation. The relative movements of wafer carrier 100 and polishing pad 104, augmented by the abrasive action of the slurry, produce a combined chemical and mechanical process at the exposed (lower) face of a wafer 120 (which is located under pressure element 108) which removes projections and irregularities to produce a substantially flat or planar surface on the lower side of the wafer 120.

Wafer carrier 100 includes a workpiece retaining assembly (generally designated by reference number 122), which, in the illustrated embodiment, is integrated with carrier housing 106. Workpiece retaining assembly 122 includes a plurality of distinct retaining elements 124 that cooperate with pressure element 108 to define a cavity for receiving at least a portion of wafer 120 (in FIG. 1, wafer 120 is shown occupying the cavity). Retaining ring elements 124 extend peripherally beyond the outside of pressure element 108, thus defining the cavity. Retaining ring elements 124 may be operatively associated with a mounting assembly 116. As mentioned above, mounting assembly 116 may be a part of carrier housing 106 (as shown) or be movably coupled to carrier housing 106. Mounting assembly 116 is configured to receive and maintain retaining ring elements 124 and to limit the movement of retaining ring elements 124.

Figure 2:
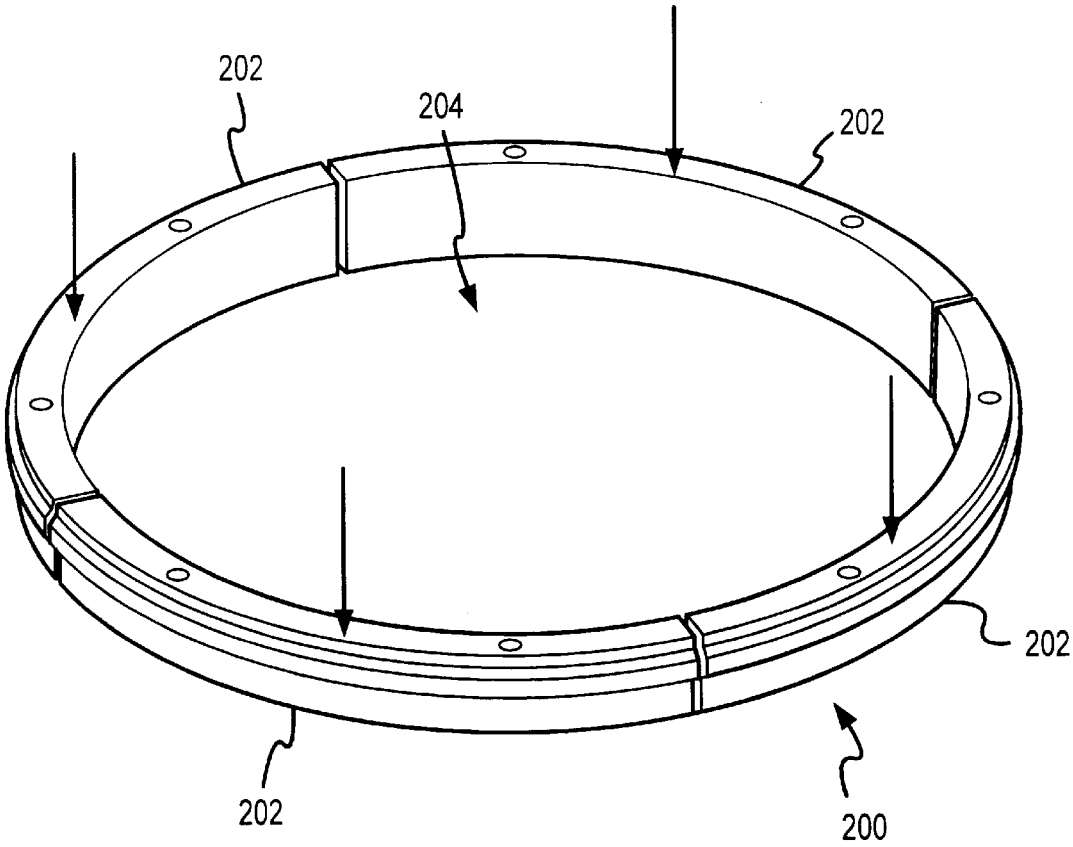
FIG. 2 is a perspective view of a segmented retaining ring for use with a workpiece carrier.

FIG. 2 shows an exemplary segmented retaining ring 200 that may be used in workpiece retaining assembly 122. It should be noted that the specific configuration of retaining ring 200 and wafer carrier 100 may differ from application to application. Although any number of distinct segments may be employed, segmented retaining ring 200 is shown with four arcuate retaining segments 202. Retaining segments 202 substantially define the outer boundary of a cavity 204 (described above). Generally, each of the distinct retaining segments 202 are capable of independent movement relative to one another. In the exemplary embodiment shown in FIG. 1, each of the retaining segments 202 are capable of independent movement relative to carrier housing 106 (in particular, each of the retaining segments 202 are capable of separate motion relative to mounting assembly 116.

Retaining segments 202 are formed from a rigid material such as steel, DELRIN, TEFLON, a polymer, a polyimide, a ceramic material, or the like. Retaining segments 202 may be coated with a diamond film, a pure polymer material, a polymer alloy material, or any suitable material to reduce friction, reduce wear, for chemical compatibility with the slurry, deionized water, or other processing compounds, and/or for compatibility with the material used for carrier housing 106. Retaining segments 202 may also employ an abrasive coating or layer (located on the pad-contacting surfaces) for performing in-situ conditioning of polishing pad 104 during processing of wafer 120. Each retaining segment 202 is preferably formed such that its lower surface, i.e., the surface that contacts polishing pad 104, is substantially flat and planar.

Figure 7:
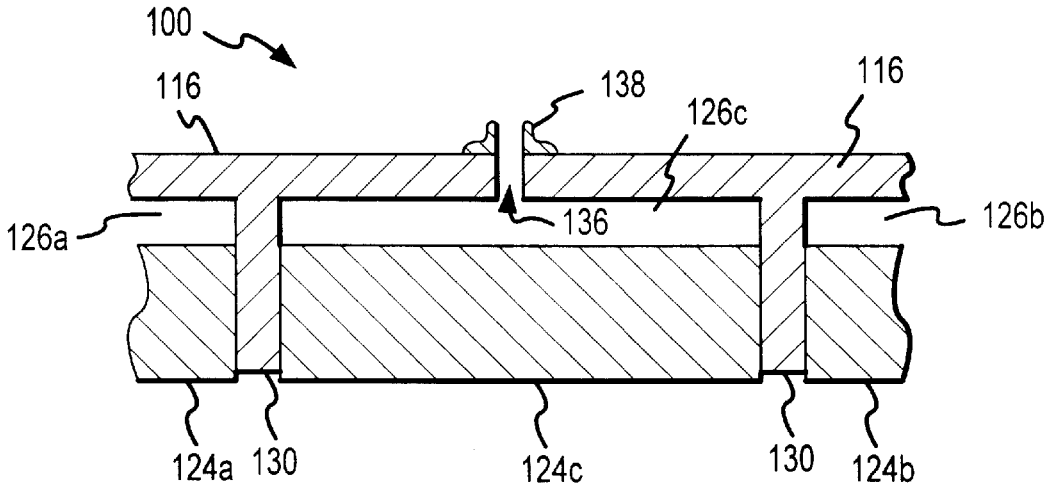
FIG. 7 is a partially cut-away side view of the workpiece carrier shown in FIG. 1.

Segmented retaining ring 200 is slidably mounted around pressure element 108 so that the individual retaining segments 202 are free to move vertically within corresponding channels 126 (see FIG. 1) formed within carrier housing 106. FIG. 7 is a partial cut away side view of wafer carrier 100. The outer flange of mounting assembly 116 is not shown in FIG. 7. Mounting assembly 116 may include a number of dividers 130 positioned between two respective retaining segments 124. Mounting assembly 116 may be round or ring shaped to accommodate arcuate retaining segments.

Figure 3:
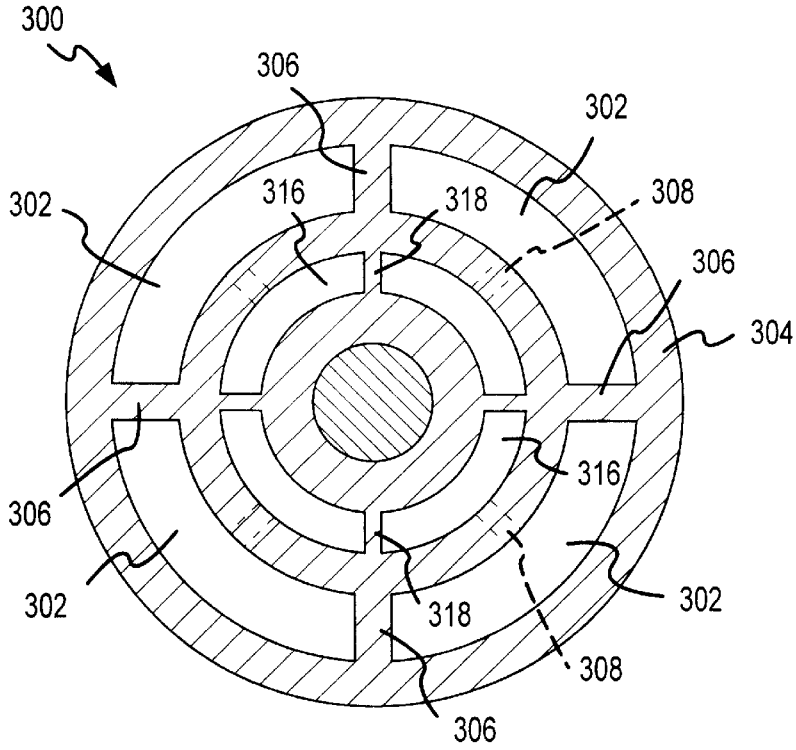
FIG. 3 is a sectional view of a first workpiece carrier, as viewed from the perspective of sectional line A—A in FIG. 1.

FIG. 3 is a sectional view of an exemplary wafer carrier 300, taken from the equivalent perspective of line A—A in FIG. 1. It should be noted that FIG. 3 is not a sectional view of wafer carrier 100. Wafer carrier 300 includes four channels 302 formed within its carrier housing 304; each of the channels 302 is configured to receive a corresponding retaining segment (not shown) such that the retaining segment is capable of independent movement within the respective channel 302. Although the preferred embodiment includes a plurality of channels 302, an alternate embodiment may employ a single channel or any suitable number of channels associated with any number of retaining segments. Channels 302 substantially define an annular channel for compatibility with arcuate retaining ring segments.

Channels 302 are separated by a plurality of partitions 306 configured to physically separate the retaining elements from one another. Partitions 306 may be an integral part of carrier housing 304. The widths of partitions 306 are exaggerated in FIG. 3; in a practical system, partitions 306 may be between 0.05 inches and 2.0 inches wide and, preferably, between 0.25 inches and 1.0 inch wide. Partitions 306 may be desirable to allow slurry to flow between the retaining segments, thus improving performance of the CMP system. Channels 302, partitions 306, and the distinct retaining segments are cooperatively configured to substantially restrict lateral movement of the retaining segments, relative to the respective pressure element. For example, wafer carrier 100 is suitably designed such that the movement of retaining segments 124 is substantially limited to the direction perpendicular to the plane defined by pressure element 108.

Figure 8:
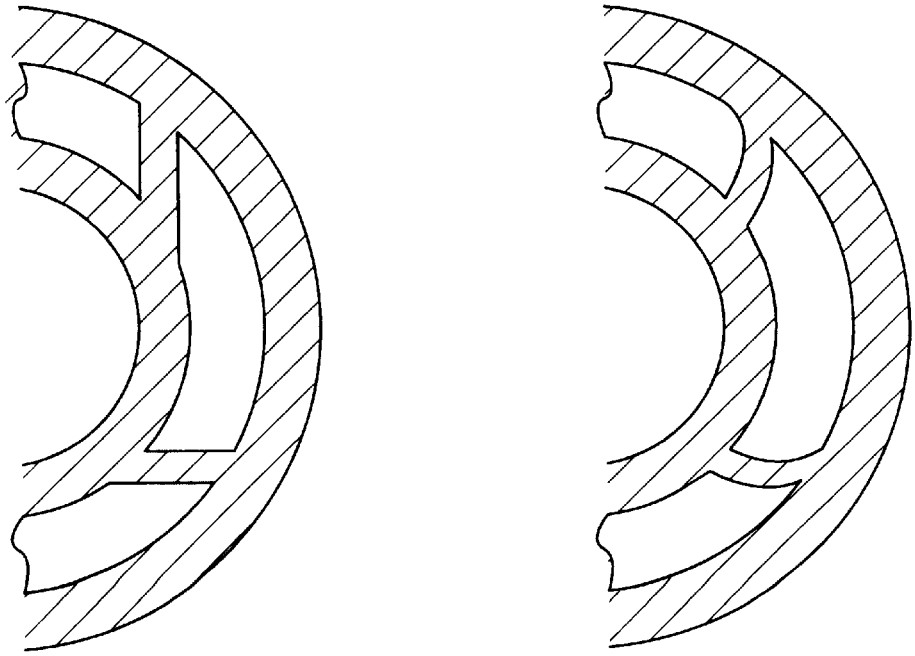
FIGS. 8 and 9 depict detailed portions of alternate workpiece carriers.

Partitions 306 may alternatively be angled or curved (rather than radial as shown in FIG. 3) to accommodate correspondingly angled or curved retaining segments. FIG. 8 illustrates one angled embodiment and one curved embodiment (other shapes may also be utilized). The retaining segments and associated channels may also be similarly shaped The angular pitch and direction of partitions 306 may vary depending upon the rotational direction of the carrier, the desired slurry flow rate, and other variables. Angled partitions 306 may be desirable to facilitate improved slurry flow to the wafer. For example, if the polishing media carries abrasive particles, then the size and sharpness of the particles arc usually controlled in a careful manner. It is well known that such polishing particles tend to break down during a polishing operation, often before the polishing operation is completed. Further, portions of the workpiece surface that are released from the workpiece will commingle with the polishing media, changing its physical and chemical composition. For these and other reasons, it is desirable that the polishing media be exchanged during a polishing operation. In prior art retainer rings, the polishing media may accumulate or "puddle" at the outer periphery of the retaining rings. However, if angled partitions 306 are employed, then such accumulation or puddling at the outer periphery of the retaining assembly does not occur, providing a visual confirmation that the polishing media is flowing across the surface of the workpiece during the polishing operation. Accordingly, angled partitions 306 can improve the flow volume, quality, and reliability of the slurry during the polishing operation.

Figure 9:
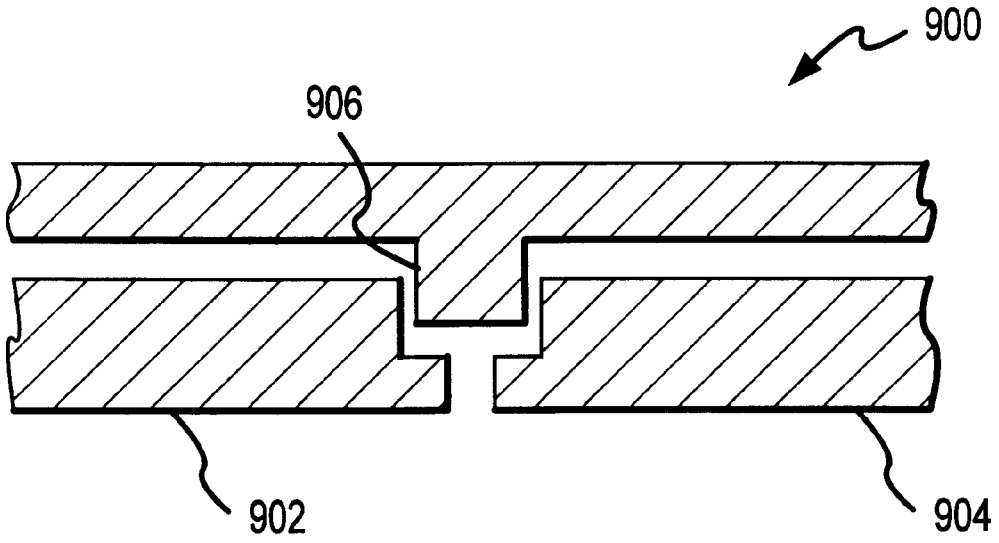

As shown in FIG. 9, the retaining segments may have a "stepped" profile that enables increased control over slurry flow to and from the wafer. FIG. 9 is a side and partially cut-away view of a portion of a carrier 900. As shown, the retaining segments 902 and 904 may be separated by a partition 906. Segments 902 and 904 may be configured such that they are relatively narrow near the polishing pad (i.e., proximate the wafer during operation) and such that they are relatively wide where partition 906 separates them. The wide partition facilitates structural integrity in carrier 900. In addition, the width variation may be utilized to alter the discontinuity of contact for the wafer independent of the partition width. Thus, the specific separation between the retaining segments 902 and 904 may vary from application to application.

Referring back to FIG. 1, the upward vertical movement of retaining ring segments 124 may be limited when a shoulder 132 formed on ring segments 124 abuts a flange 134 formed on mounting assembly 116. The downward vertical movement of retaining ring segments 124 may be similarly limited. In operation, retaining ring segments 124 are configured to "float" within their respective channels 126; in an ideal operating environment, the lower surfaces of retaining segments 124 are maintained at approximately the same level as the polished surface of wafer 120. Accordingly, workpiece carrier 100 includes a mechanism for biasing the position of the distinct retaining elements relative to mounting assembly 116. Equivalently, carrier 100 may include a suitable mechanism for biasing the position of the retaining elements relative to each other or relative to any reference point, plane, surface, or line associated with carrier 100 or the operating environment.

The position of ring segments 124 may be actively and individually controllable to enable direct access to the wafer holding surface of the carrier. The individual control of ring segments 124 may be desirable to allow a wafer-edge-gripping robotic end effector to easily load the wafers directly into carrier 100 (one ring segment 124 may be retracted to provide access to the area defined by the remaining ring segments 124). In contrast, the "pocket" associated with a one-piece retaining ring is eliminated when the ring is retracted; it is impossible to align or adjust the position of the wafer in a one-piece retaining ring using an edge-gripping effector.

The retaining segment biasing mechanism may include one or more pressure chambers 126 formed within carrier housing 106 and/or mounting assembly 116. FIG. 3 depicts four distinct and separate chambers 316 associated with four different retaining ring segments. Pressure chambers 126, 316 are configured to receive pressurized fluid from a suitable source. In a multiple-chamber embodiment, the pressurized fluid may be separately regulated for each chamber, possibly resulting in differential pressures being applied to the various retaining segments 124. In an alternate embodiment, the chambers may be filled with pressurized fluid and sealed to form a passive biasing mechanism rather than an actively controlled dynamic biasing mechanism. For illustrative purposes, single-chambered, active biasing embodiment will be described with reference to FIG. 1.

Wafer carrier housing 106 (or any suitable component of carrier 100, such as mounting assembly 116) may include any number of fluid conduits 136 formed therein. Fluid conduits 136 are configured to provide pressurized fluid to chambers 126. A number of suitable fittings 138 that communicate with fluid conduits 136 may be utilized to facilitate the attachment of fluid hoses or tubes to carrier 100. Alternatively, the pressurized fluid may be routed through drive shaft 102, which may be hollowed for this purpose. In an alternate embodiment, carrier 100 may utilize the same pressurized fluid to downwardly bias pressure element 108. A fluid source (not shown) typically provides pressurized air, but other gases or liquids could be used to pressurize chambers 126. It should be appreciated that the amount of pressure applied to retaining segments 124 may vary depending on the particular application.

As described above, a given conduit 136 preferably communicates with a respective chamber 126 such that the pressurized air is present in chamber 126. The fluid pressure within channels 126 is employed to bias wafer retaining segments 124 against polishing pad 104. In this manner, air (or other fluid) pressure applied to channel 126 is translated, via the upper surface area of the retaining ring segments, into a biasing force applied to polishing pad 104 by the lower surface of the retaining ring segments. The bias pressure applied by retaining ring segments 124 to polishing pad 104 is determined by the ratio of the upper and lower surface areas of retaining ring segments 124. Wafer carrier 100 may employ any suitable number of sealing elements, such as O-rings, to control the amount of fluid leakage out of channels 126. The arrows in FIG. 2 depict the downward force exerted against the upper surface of the retaining elements by the pressurized fluid.

If the same fluid pressure is utilized to drive all of the retaining segments 124, then the down force imparted by each retaining segment 124 is substantially equal. Consequently, even if the heights or relative flatness of retaining segments 124 differ, the equal pressure and down-force enables retaining segments 124 to self-correct. The self-correcting nature of distinct retaining segments 124 facilitates effective polishing of wafer 120 notwithstanding the potential for different localized wear patterns associated with the retaining segments 124.

The retaining segment biasing mechanism may be configured in accordance with any number of alternate techniques. For example, the position of retaining segments 124 may be dynamically or statically controlled with a fluid pressure system, a spring system, a pushrod system, a fluid bladder system, an air cylinder system, an electromechanical solenoid system, or the like. The details of such alternate biasing systems will not be described in detail herein.

Referring again to FIG. 3, wafer carrier 300 utilizes a plurality of separate pressure chambers 316 rather than a single chamber. Chambers 316 may be formed directly above channels 302 (similar to the embodiment shown in FIG. 1) or offset from channels 302 (as shown in FIG. 3). Chambers 316 may be separated by suitable partitions 320 such that chambers 316 are fluidly isolated from each other. In this embodiment, each chamber 316 is associated with a respective fluid aperture 308 such that pressurized fluid present within a given chamber can communicate with a respective channel 302. Although not a necessity, each chamber 316 may be coupled to a separately controlled fluid source such that the movement of each retaining ring segment can be independently regulated. Enhanced control of retaining ring segments facilitates improved uniformity and localized control of the wafer edge profile. Furthermore, the control of the individual retaining ring segments may be responsive to any number of process parameters, e.g., end-point detection, localized thickness measurements, polishing pad temperature, polishing pad conditioning, slurry flow rate, wafer temperature, or the like, to provide a dynamic feedback-controlled polishing procedure.

Figure 5:
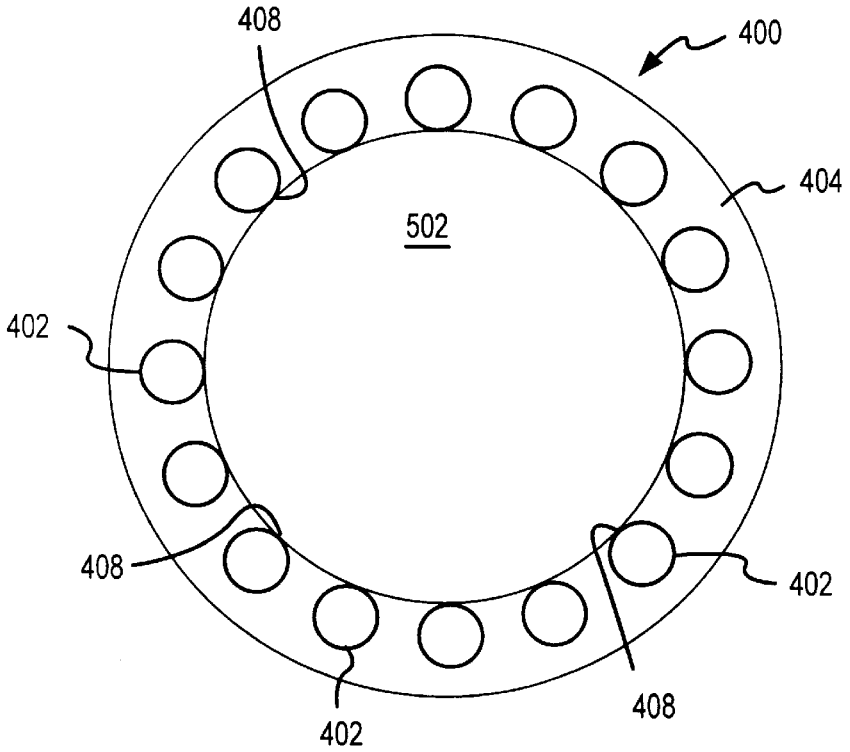
FIG. 5 is a bottom plan view of the workpiece carrier shown in FIG. 4, with a workpiece positioned therein.
Figure 4:
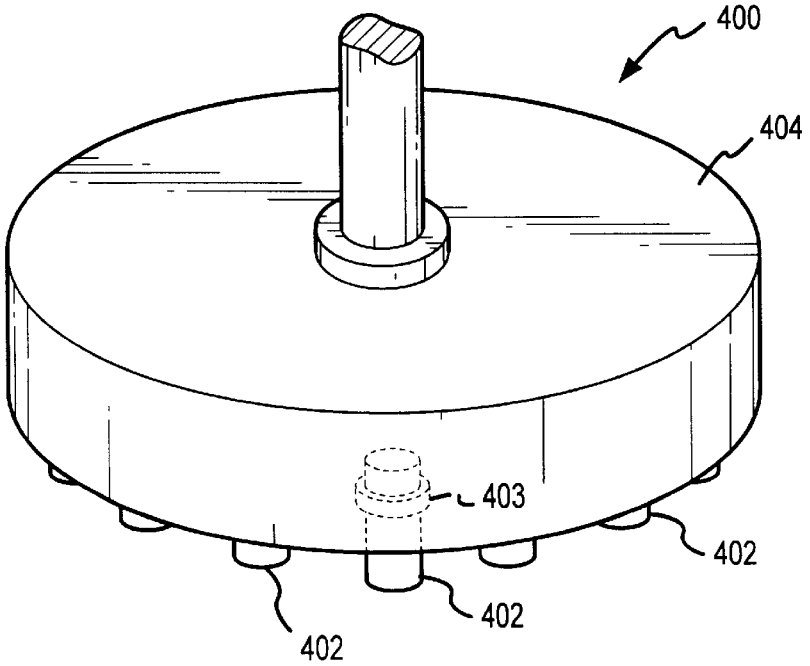
FIG.4 is a perspective view of an exemplary workpiece carrier according to an alternate embodiment of the present invention.

FIG. 4 is a perspective view of an alternate wafer carrier 400 that employs a plurality of retaining pins 402 rather than a segmented retaining ring assembly. Retaining pins 402 are preferably formed from a rigid material, such as steel, DELRIN, TEFLON, a polymer, a polyimide, a ceramic material, or the like. As described above in connection with retaining segments 115, retaining pins 402 may be coated with a suitable material to reduce the friction associated with the movement of retaining pins 402 or to aid in pad conditioning. Wafer carrier 400 includes a carrier housing 404 within which retaining pins 402 independently move in a vertical direction. FIG. 5 is a bottom plan view of wafer carrier 400 with a corresponding wafer 502 positioned therein. Retaining pins 402 cooperate with a pressure element (obscured from view by wafer 502) to substantially define a cavity for receiving wafer 502. In operation, the innermost points 408 of retaining pins 402 substantially follow the outer edge of wafer 502.

As described above in connection with ring segments 124, the relative positions of retaining pins 402 may also be individually and actively controlled by a suitable control mechanism. Such independent position control can facilitate an effective loading and unloading of wafers into carrier 400.

Retaining pins 402 having a round longitudinal cross section may be desirable for ease of manufacture and to enable retaining pins 402 to spin about their longitudinal axes during operation. If retaining pins 402 are capable of independent rotation about their longitudinal axes, then the adverse effects of polishing pad friction (e.g., uneven wear of retaining pins 402, vibrations, or the like) may be reduced. Alternatively, retaining pins having an arcuate inner surface may be employed to reduce the localized wafer stresses that may otherwise be caused by point-to-point contacts. Indeed, the cross sectional profile of retaining pins 402 (and the retaining segments described above in connection with the first embodiment) may be variously shaped to control slurry flow, the contortion of polishing pad 104, the downforce imparted onto polishing pad 104, and other operational parameters. For example, the cross sectional profile may be characterized by a chamfered, angled, or stepped outer edge. As described above in connection with the first embodiment, the relative separation of retaining pins 602 may vary from system to system. A relatively wide spacing can be employed to enhance the flow of slurry to wafer 502.

Figure 6:
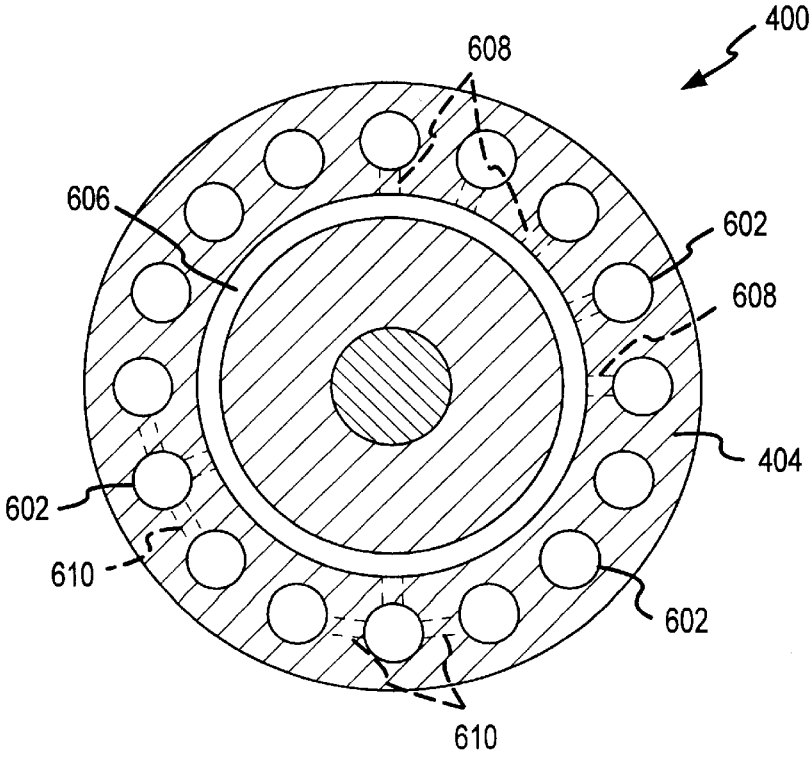
FIG. 6 is a sectional view of a second workpiece carrier, as viewed from the perspective of sectional line A—A in FIG. 1.

FIG. 6 is a sectional view of wafer carrier 400, as viewed from the equivalent perspective of line A—A in FIG. 1. It should be appreciated that FIG. 1 does not illustrate an embodiment utilizing straight retaining pins, however, the concepts described herein are applicable to retaining pins having any configuration or cross sectional shape. As shown in FIG. 6, carrier housing 404 includes a plurality of guide sleeves 602 formed therein. Each retaining pin 402 is slidably maintained within a corresponding guide sleeve 602 such that each retaining pin 402 is capable of independent movement within the respective guide sleeve 602. As described above in connection with the segmented retaining ring embodiment, retaining pins 402 are capable of independent motion in a direction substantially perpendicular to the pressure element (and perpendicular to wafer 502). In the preferred embodiment, guide sleeves 602 and retaining pins 402 are cooperatively configured such that the movement of retaining pins 402 is limited to the vertical direction.

As depicted in FIG. 4, retaining pins 402 may include a collar 403 (or an equivalent structure) that serves to restrict the movement of retaining pins 402 within guide sleeves 602. As described above with respect to the first embodiment, collar 403 may cooperate with upper and/or lower shoulders integral to carrier housing 404 to restrict the upper and lower travel of retaining pins 402.

During operation, retaining pins 402 are biased toward the lower end of carrier housing 404, i.e., toward the polishing surface. In accordance with the illustrated embodiment, pressurized fluid is used to regulate the movement of retaining pins 402. With continued reference to FIG. 1, each guide sleeve 602 can be pressurized with a suitable fluid such that a downward force is imparted to a corresponding retaining pin 402. For simplicity, FIG. 6 shows a single fluid chamber 606 (equivalent to chamber 126 in FIG. 1) rather than a plurality of distinct fluid chambers. Nonetheless, as described above in connection with the segmented retaining ring embodiment, wafer carrier 400 may alternatively utilize any number of separately pressurized fluid chambers to enable the flexible control of the distinct retaining pins 402.

A plurality of fluid apertures 608 formed within carrier housing 404 serve as conduits for the pressurized fluid to flow into guide sleeves 602. Carrier housing 404 may incorporate any suitable aperture network such that pressurized air is delivered to the various guide sleeves 602. For example, two or more guide sleeves may be fluidly connected via linking apertures 610. The individual retaining pins 402 may be suitably sealed (with O-rings or the like) to prevent or control the leakage of pressurized fluid from guide sleeves 602.

In operation, pressurized fluid is introduced to chamber 606 in any suitable manner. The pressurized fluid communicates with guide sleeves 602 via apertures 608, apertures 610, or the like. The pressurized fluid exposed to the upper surfaces of retaining pins 402 forces retaining pins 402 down toward the lower end of carrier housing 404. In this manner, retaining pins 402 are pushed against the polishing surface during the polishing procedure. Retaining pins 402 may also be suitably configured to facilitate loading and unloading of wafer 502 from wafer carrier 404 and/or to otherwise grip wafer 502 during processing. For example, retaining pins 402 and guide sleeves 602 may be cooperatively configured to impart a slight inward pressure against the edge of wafer 502 during loading, unloading, and polishing. The inward pressure may be removed to release wafer 502 and the inward pressure may be adjusted during polishing depending upon the particular application. As described above, the position of retaining pins 402 may be individually and independently regulated to make loading, unloading, and alignment easy.

The overall structure of the retaining assembly may be alternately configured in any suitable manner. For example, workpiece carrier 100 may utilize a self-contained and independently controlled retaining assembly having a plurality of distinct retaining elements (in contrast to a retaining assembly that cooperates with other components and/or features of carrier 100). In this context, carrier 100 may include an array of retaining pins or a plurality of retaining segments that are mounted in a housing that is distinct from carrier housing 105. The movement of the distinct retaining pins or retaining segments may be regulated by a control system that is independent from other controlled features of carrier 100 (e.g., the downforce associated with pressure element 108, the rotation of carrier housing 105, or the like). Furthermore, a retaining assembly having distinct retaining elements may be employed in the context of any number of carrier designs, e.g., those utilizing floating pressure plates, pressurized bladders, or carrier housings having a number of independently movable components operatively coupled together.

In summary, the present invention provides an improved floating retaining structure for use with a workpiece carrier clement. The improved retaining stricture promotes a more uniform compression of the polishing surface and, consequently, a more uniform polishing of the workpiece. Individually controlled retaining elements may be utilized to provide an enhanced amount of polishing control near the edge of the wafer. In addition, the use of distinct retaining elements, rather than a one-piece structure, reduces maintenance costs and the downtime associated with repairs.

The present invention has been described above with reference to preferred embodiments. However, those skilled in the art will recognize that changes and modifications may be made to the preferred embodiments without departing from the scope of the present invention. For example, the particular retaining element biasing mechanism is merely exemplary, and many alternate fluid delivery configurations may be employed. In addition, the specific arrangement, number, size, and shape of the retaining ring segments and retaining pins may vary from system to system. These and other changes or modifications are intended to be included within the scope of the present invention, as expressed in the following claims.

What is claimed is:

1. A workpiece carrier for use with a workpiece polishing system, said workpiece carrier comprising:

a carrier housing having an upper end and a lower end;

a pressure element operatively associated with said carrier housing and being configured to hold a workpiece against a polishing surface during a polishing operation associated with said workpiece polishing system, wherein said pressure element substantially defines a plane; and a workpiece retaining assembly operatively associated with said carrier housing, wherein said workpiece retaining assembly comprises:

a plurality of distinct retaining elements, each of said distinct retaining elements being capable of independent movement relative to one another, wherein said movement is in a direction substantially perpendicular to said plane; and means for biasing a position of said plurality of distinct retaining elements relative to said carrier housing, wherein said means for biasing comprises:

a plurality of separate chambers formed within said carrier housing, each of said plurality of chambers being configured to communicate with at least one of said distinct retaining elements; and a fluid source for supplying said plurality of chambers with a pressurized fluid such that said pressurized fluid applies a downward force, relative to said upper end of said carrier housing, to said distinct retaining elements.

2. A workpiece carrier for use with a workpiece polishing system, said workpiece carrier comprising:

a carrier housing having an upper end and a lower end;

a pressure element operatively associated with said carrier housing and being configured to hold a workpiece against a polishing surface during a polishing operation associated with said workpiece polishing system; and a workpiece retaining assembly operatively associated with said carrier housing, wherein said workpiece retaining assembly comprises:

a plurality of distinct retaining elements, each of said distinct retaining elements being capable of independent movement relative to one another; and a number of partitions configured to physically separate said distinct retaining elements from one another.

3. A workpiece carrier for use with a workpiece polishing system, said workpiece carrier comprising:

a carrier housing having an upper end and a lower end;

a pressure element operatively associated with said carrier housing and being configured to hold a workpiece against a polishing surface during a polishing operation associated with said workpiece polishing system; and a workpiece retaining assembly operatively associated with said carrier housing, wherein:

said workpiece retaining assembly comprises a plurality of distinct retaining elements, each of said distinct retaining elements being capable of independent movement relative to one another; and said distinct retaining elements are configured to impart an inward pressure, relative to a workpiece, during processing of said workpiece.

4. A workpiece carrier for use with a workpiece polishing system, said workpiece carrier comprising:

a carrier housing having an upper end and a lower end;

a pressure element operatively associated with said carrier housing and being configured to hold a workpiece against a polishing surface during a polishing operation associated with said workpiece polishing system; and a workpiece retaining assembly operatively associated with said carrier housing, wherein said workpiece retaining assembly comprises a plurality of distinct retaining elements, each of said distinct retaining elements being capable of independent movement relative to one another; and wherein the relative positions of said distinct retaining elements are actively and individually controllable.

5. A workpiece carrier for use with a workpiece polishing system, said workpiece carrier comprising:

a carrier housing having an upper end and a lower end;

a pressure element associated with said carrier housing and being configured to hold a workpiece against a polishing surface during a polishing operation associated with said workpiece polishing system;

at least one channel, formed within said carrier housing, wherein said at least one channel substantially defines an annular channel; and a plurality of distinct retaining elements slideably maintained within said at least one channel, wherein each of said distinct retaining elements comprises an arcuate ring segment and each of said distinct retaining elements is capable of independent movement within said at least one channel.

6. A workpiece carrier according to claim 5, wherein said at least one channel comprises a plurality of annular channels separated by a plurality of angled partitions configured to physically separate said distinct retaining elements from one another, said angled partitions being angled relative to a radial direction associated with said annular channels.

7. A workpiece carrier according to claim 5, wherein said at least one channel comprises a plurality of channels separated by a plurality of partitions configured to physically separate said distinct retaining elements from one another.

8. A workpiece carrier according to claim 7, wherein at least one of said plurality of partitions is curved.

9. A workpiece carrier according to claim 7, wherein said channels, said partitions, and said distinct retaining elements are cooperatively configured to substantially restrict lateral movement of said distinct retaining elements, relative to said pressure element.

10. A workpiece carrier for use with a workpiece polishing system, said workpiece carrier comprising:

a carrier housing having an upper end and a lower end;

a pressure element coupled to said carrier housing and being configured to bias a workpiece away from said upper end during a polishing operation associated with said workpiece polishing system;

a plurality of guide sleeves formed within said carrier housing; and a plurality of pins, each being slideably maintained within a corresponding one of said guide sleeves, wherein each of said pins is capable of independent movement within a respective one of said guide sleeves, and wherein the relative positions of said pins are actively and individually controllable.

* * * * *